United States Patent [19]

Chang et al.

[11] 3,954,528

[45] May 4, 1976

[54] SOLID GAS GENERATING AND GUN PROPELLANT COMPOSITION CONTAINING TRIAMINOGUANIDINE NITRATE AND SYNTHETIC POLYMER BINDER

[75] Inventors: Marguerite S. Chang, Forest Heights; John H. Highby, Indian Head; Gerald L. Mackenzie, Port Tobacco, all of Md.

[73] Assignee: The United States of America as represented by the Secretary of the Navy, Washington, D.C.

[22] Filed: Nov. 6, 1970

[21] Appl. No.: 97,444

[52] U.S. Cl. ..... 149/19.4; 149/19.1; 149/19.5; 149/19.6; 149/19.9; 149/19.91; 149/92

[51] Int. Cl.[2] ..... C06B 45/10

[58] Field of Search ..... 149/92, 19, 19.1, 19.4, 149/19.5, 19.6, 19.9, 19.91

[56] References Cited

UNITED STATES PATENTS

| | | | |
|---|---|---|---|
| 2,929,699 | 3/1906 | Audrieth et al. | 149/92 X |
| 3,117,044 | 1/1964 | Sauer et al. | 149/19 |
| 3,123,507 | 3/1964 | Butts et al. | 149/92 X |

*Primary Examiner*—Edward A. Miller
*Attorney, Agent, or Firm*—R. S. Sciascia; J. A. Cooke

[57] ABSTRACT

Solid gas generating and gun propellant compositions employing triaminoguanidine nitrate as a propellant ingredient in admixture with an oxidant and a suitable compatible binder material.

7 Claims, No Drawings

SOLID GAS GENERATING AND GUN PROPELLANT COMPOSITION CONTAINING TRIAMINOGUANIDINE NITRATE AND SYNTHETIC POLYMER BINDER

BACKGROUND OF THE INVENTION

This invention relates generally to solid composite propellant compositions and more particularly to solid composite propellant compositions especially useful as gas generators and gun propellants.

Recently, there has been a great demand for new gas generating propellants and gun propellants which are cool burning, noncorrosive and yield a high amount of gas since attempts to improve existing gas generating compositions and gun propellants have been unsuccessful for various reasons. For example, while the addition of certain modifiers has lowered the flame temperature and increased gas production, these same modifiers have contributed to the production of undesirable corrosive products. In turn, other modifiers utilized in the past, while not producting corrosive materials, have not succeeded to significantly lower the flame temperature or increase gas evolution.

SUMMARY OF THE INVENTION

Accordingly, it is one object of this invention to provide a new solid composite gas generating and gun propellant composition.

Another object of the present invention is to provide a solid composite gas generating and gun propellant composition which is cool burning and produces a high percentage of gas upon combustion.

Still another object of the instant invention is to provide a solid composite gas generating and gun propellant which yields only non-corrosive materials upon combustion.

These and other objects are achieved by providing a composite propellant composition comprising an oxidant, such as cyclotetramethylenetetranitramine (HMX), triaminoguanidine nitrate (TAGN), and a suitable binder.

DESCRIPTION OF THE PREFERRED EMBODIMENTS

Pursuant to the present invention, an improved gas generating and gun propellant is provided by an admixture of an oxidant, preferably, cyclotetramethylenetetranitramine (HMX) in an amount of from about 5 to about 85 percent by weight, triaminoguanidine nitrate in an amount of from about 5 to about 70 percent by weight and a suitable compatible organic polymeric binder in an amount of from about 5 to about 30 percent by weight of the total composition.

Although, HMX is the preferred oxidant of the instant composition, other oxidants, which are traditionally employed for this purpose and are compatible with the TAGN propellant ingredient of this invention, may also be employed. Some of these are, for example, cyclotrimethylenetrinitramine (RDX), ammonium nitrate, 5-aminotetrazole nitrate, ammonium perchlorate and mixtures thereof. It should be noted, however, that where the absence of non-corrosive gases upon combustion is desired ammonium perchlorate is not particularly suitable.

The triaminoguanidine nitrate ingredient of the instant invention is a nitrogen rich compound with a reasonably high melting point. When employed herein as a propellant ingredient, it imparts a low flame temperature, provides for good burning characteristics, and increases the amount of gas produced upon combustion of the instant propellant compositions. Triaminoguanidine nitrate may be synthesized according to known processes and is commercially available in hydrochloride salt form.

The optimum amount of the triaminoguanidine nitrate salt utilized in the propellant compositions of this invention is generally dependent upon the application of the composition. For gas generator purposes, the TAGN content should not exceed about 50 percent by weight of the total composition, while for gun propellant use higher quantities are applicable.

The oxidant and TAGN of the present invention may be incorporated into any compatible conventional binder matrix material. Generally, these are, for example, gum rubbers of polyisoprene, polyisobutylene, butyl rubber, polyesters, polybutandienes, polyurethanes, polyglycols, polybutadienes with hydroxy or carboxy functionality, polyesters with hydroxy functionality, polyethers, vinyltetrazole polymers, glycidyl ether epoxy resins, and copolymers, etc.

More specifically, binder materials such as polyglycol adipate, Butarez CTL I (a mixture of carboxyl-terminated polybutadiene and non-functional polybutadiene) Butarex CTL II (carboxyl-terminated polybutadiene), the terpolymer of 2-methyl-5-vinyltetrazole: butyl acrylate: acrylic acid, and R-45M (a hydroxyl-terminated polybutadiene) are within the scope of this invention.

A number of other materials may also be added in minor amounts to the propellant compositions of this invention. These include for examples, coolants like oxamide, ammonium oxalate, oxilic acid, and guanidine nitrate; plasticizers such as dioctyladipate, wetting agents such as lecithin, crosslinking and curing agents such as di and trifunctional epoxides and ferric acetylacetonate (FeAA), other burning rate and ballistic modifiers, such as lead chromate, and vulcanizing agents like sulfur and sulfur containing compounds.

Having generally described the invention the following examples are set forth for purposes of illustration. It will be understood that the invention is not limited to these examples, but is susceptible to different modifications that will be recognized by one of ordinary skill in the art.

EXAMPLE 1

| Composition | % weight |
|---|---|
| HMX | 75.0 |
| TAGN | 13.0 |
| R 45M (hydroxyl-terminated polybutadiene, molecular weight 2600, OH functionality 2.4, a product of Sinclair Petrochemicals, N.Y., N.Y.) | 11.2 |
| toluene diisocyanate | 0.8 |

Theoretical Calculations

Chamber temperature at constant P(1000 psi): 2255°K

Chamber temperature at constant V : 2800°K

Moles of gas: 5.155

Experimental Data

Thermal stability at 95°C: one month without a change in weight (in another formulation which was prepared the R45M binder was treated with 1 percent phenyl-β-naphthylamine at 140°F. The propellant was exceptionally stable and had a better retention of physical properties).

Flame temperature in Closed Bomb Test:
2208°K (300 psi), about 2358°K at 1000 psi

EXAMPLE 2

| Composition | % weight |
|---|---|
| 5-aminotetrazole nitrate | 71.5 |
| TAGN | 8.5 |
| binder (45 percent 1-methyl-5-vinyltetrazole<br>45 percent methoxy ethyl-methyl-tetrazole<br>6 percent ethylene dimethylacrylate<br>4 percent cumene hydroperoxide) | 20.0 |
| DTA Ti: 148.0 | |
| Burning rate 1000 psi; 77°F : 0.634 in./sec. | |

EXAMPLE 3

| Composition | % weight |
|---|---|
| TAGN | 10.0 |
| ammonium nitrate | 74.8 |
| polyisoprene rubber - 305 (Shell Oil Co.) | 12.75 |
| sulfur | 0.1 |
| p-quinone dioxime | 0.1 |
| Conco Oil | 2.25 |

EXAMPLE 4

| Composition | % weight |
|---|---|
| TAGN | 20.0 |
| ammonium nitrate | 64.8 |
| polyisoprene rubber - 305 (Shell Oil Co.) | 12.75 |
| sulfur | 0.1 |
| p-quinone dioxime | 0.1 |
| Conco Oil | 2.25 |

EXAMPLE 5

| Composition | % weight |
|---|---|
| TAGN | 30.0 |
| ammonium nitrate | 54.8 |
| polyisoprene rubber - 305 (Shell Oil Co.) | 12.75 |
| sulfur | 0.1 |
| p-quinone dioxime | 0.1 |

-continued

| Composition | % weight |
|---|---|
| Conco Oil | 2.25 |

The propellant compositions of the instant invention are readily formulated according to conventional propellant mixing procedures; i.e., the solids, e.g., TAGN, HMX etc., are mixed with the organic binder and curing or crosslinking agent, extruded or compression molded, and subsequently heat cured.

Having thus described the invention, what is claimed as new and desired to be secured by Letters Patent of the United States is:

1. A composite propellant composition comprising (1) an oxidant selected from the group consisting of cyclotetramethylene tetranitramine, cyclotrimethylene trinitramine, ammonium nitrate, 5-aminotetrazole nitrate, ammonium perchlorate and mixtures thereof, (2) triaminoguanidine nitrate, and a compatible synthetic polymer binder.

2. The composite propellant composition of claim 1 wherein said oxidant is present in an amount within the range of from about 5 to about 85 percent by weight, said triaminoguandine nitrate is present in an amount within the range of from about 5 to about 70 percent by weight and said binder is present in an amount within the range of from about 5 to about 30 percent by weight of the total composition.

3. The composite propellant composition of claim 2 wherein said oxidant is selected from the group consisting of cyclotetramethylenetetranitramine, ammonium nitrate, 5-aminotetrazole nitrate, and mixtures thereof.

4. The composite propellant composition of claim 3 wherein said compatible binder is a polymer selected from the group consisting of polyisoprene, polyisobutylene, butyl rubber, a polyester, a polyurethane, a polyglycol, a polybutadiene, a polybutadiene having carboxy functionality, a polybutadiene having hydroxy functionality, a polyester having hydroxy functionality, a polyether, a polyvinyltetrazole, a glycidyl ether epoxy resin and copolymers thereof.

5. The composite propellant composition of claim 4 wherein said oxidant is cyclotetramethylenetetranitramine, and said compatible binder is a polymer of hydroxyl-terminated polybutadiene cured with an isocyanate.

6. The composite propellant composition of claim 4 wherein said oxidant is ammonium nitrate and said compatible binder is polyisoprene.

7. The composite propellant composition of claim 3 wherein said oxidant is cyclotetramethylenetranitramine.

* * * * *